United States Patent [19]

Aoyama

[11] Patent Number: 4,560,168

[45] Date of Patent: Dec. 24, 1985

[54] GOLF BALL

[75] Inventor: Steven Aoyama, Glendale Hts., Ill.

[73] Assignee: Wilson Sporting Goods Co., River Grove, Ill.

[21] Appl. No.: 604,726

[22] Filed: Apr. 27, 1984

[51] Int. Cl.[4] ..... A63B 37/14

[52] U.S. Cl. ..... 273/232

[58] Field of Search ..... 273/232, 62, 213, 233; 40/327

[56] References Cited

U.S. PATENT DOCUMENTS 4,141,559 2/1979 Melvin et al. ..... 273/232 X
4,142,727 3/1979 Shaw et al. ..... 273/232

FOREIGN PATENT DOCUMENTS 967185 5/1975 Canada ..... 273/232
1005480 2/1977 Canada ..... 273/232
377354 7/1932 United Kingdom ..... 273/232

*Primary Examiner*—George J. Marlo

[57] ABSTRACT

A golf ball is provided with evenly and uniformly distributed dimples so that six great circle paths on the surface of the golf ball do not intersect any dimples. The spherical surface of the golf ball is divided into 20 identical spherical triangles corresponding to the faces of a regular icosahedron. Each of the 20 triangles is further subdivided into four smaller triangles consisting of a central triangle and three apical triangles by connecting the midpoints of each of the 20 triangles along great circle paths. The dimples are arranged so that the dimples do not intersect the sides of any of the central triangles.

29 Claims, 24 Drawing Figures

-------PARTING LINE ———ICOSAHEDRAL TRIANGLE BOUNDARY

| DIMP. POS. | CHORD (IN.) |
|---|---|
| 1 | .135 |
| 2 | .135 |
| 3 | .140 |
| 4 | .140 |
| 5 | .150 |
| 6 | .135 |
| 7 | .135 |

------ PARTING LINE

——— ICOSAHEDRAL TRIANGLE BOUNDARY

| DIMP. POS. | CHORD (IN.) |
|---|---|
| 1 | .135 |
| 2 | .135 |
| 3 | .135 |
| 4 | .135 |
| 5 | .135 |
| 6 | .135 |
| 7 | .135 |

------ PARTING LINE

——— ICOSAHEDRAL TRIANGLE BOUNDARY

| DIMP. POS. | CHORD (IN.) |
|---|---|
| 1 | .175 |
| 2 | .175 |
| 3 | .175 |
| 4 | .160 |
| 5 | .145 |
| 6 | .145 |

-------- PARTING LINE ——— ICOSAHEDRAL TRIANGLE BOUNDARY

| DIMP. POS. | CHORD (IN.) |
|---|---|
| 1 | .175 |
| 2 | .155 |
| 3 | .150 |

------ PARTING LINE

——— ICOSAHEDRAL TRIANGLE BOUNDARY

| DIMP. POS. | CHORD (IN.) |
|---|---|
| 1 | .125 |
| 2 | .125 |
| 3 | .175 |
| 4 | .175 |
| 5 | .160 |
| 6 | .145 |

------ PARTING LINE ——— ICOSAHEDRAL TRIANGLE BOUNDARY

| DIMP. POS. | CHORD (IN.) |
|---|---|
| 1 | .115 |
| 2 | .080 |
| 3 | .115 |
| 4 | .090 |
| 5 | .120 |
| 6 | .090 |
| 7 | .080 |
| 8 | .100 |
| 9 | .115 |
| 10 | .090 |

------- PARTING LINE ——— ICOSAHEDRAL TRIANGLE BOUNDARY

| DIMP. POS. | CHORD (IN.) |
|---|---|
| 1 | .080 |
| 2 | .080 |
| 3 | .080 |
| 4 | .080 |
| 5 | .090 |
| 6 | .090 |
| 7 | .090 |
| 8 | .090 |
| 9 | .090 |
| 10 | .090 |
| 11 | .090 |
| 12 | .090 |
| 13 | .090 |

------- PARTING LINE

——— ICOSAHEDRAL TRIANGLE BOUNDARY

| DIMP. POS. | CHORD (IN.) |
|---|---|
| 1 | .080 |
| 2 | .080 |
| 3 | .080 |
| 4 | .080 |
| 5 | .080 |
| 6 | .080 |
| 7 | .080 |
| 8 | .075 |
| 9 | .075 |
| 10 | .075 |
| 11 | .075 |
| 12 | .075 |
| 13 | .075 |
| 14 | .075 |
| 15 | .075 |
| 16 | .075 |

GOLF BALL

BACKGROUND

This invention relates to golf balls, and, more particularly, to a golf ball which has dimples which are evenly and uniformly distributed so that the ball has six axes of symmetry.

For maximum consistency and accuracy, golf ball dimples should be evenly and uniformly distributed, with many axes of symmetry and without bald patches or dimple-free areas. However, the existence of a mold parting line resulting from molding the golf ball cover has traditionally limited the number of axes of symmetry to three or less. Recent attempts to increase this number by introducing multiple false parting lines have yielded patterns with large bald patches. For example, U.S. Pat. No. 4,142,727 describes a golf ball in which the spherical surface of the ball is divided into twelve areas corresponding to the faces of a regular dodecahedron. The surface includes from 12 to 30 rectangular bald patches or dimple-free areas. The patent also refers to dividing the surface of the ball into areas corresponding to an octahedron or an icosahedron. In each case, however, from 12 to 30 bald patches will be present.

U.S Pat. No. 4,141,559 describes a dimple pattern which generates an icosahedral lattice of equilateral spherical triangles, each triangle containing an equal number of dimples. However, this patent specifically states in column 4, lines 56–61 that "all circumferential pathways of substantial width (0.005 inch or greater) that may be circumscribed about the ball (except that at the flash line [parting line], which is the equator of the ball) will interest [sic: should be "intersect"] several of the depressions." In other words, the only circumferential pathway or great circle path which does not intersect dimples is the mold parting line.

British Patent No. 1,381,897 describes with respect to FIGS. 10–13 a dimple pattern formed by dividing the surface into the twenty triangles of an icosahedron and filling the triangles with dimples at points where great circle paths intersect. The dimples at the mold parting line are adjusted so that no dimples fall on the parting line.

SUMMARY OF THE INVENTION

The invention provides a variety of dimple patterns for golf balls, each pattern having multiple parting lines. The actual mold parting line corresponds to one of the parting lines, and the other parting lines provide axes of symmetry which correspond to the axis associated with the actual mold parting line. The dimple pattern is obtained by dividing the spherical surface of the golf ball into twenty spherical triangles corresponding to the faces of a regular icosahedron. Each of the twenty triangles is further divided into four smaller triangles—one central triangle and three apical triangles at the three apexes of the larger triangle—by connecting the midpoints of the sides of the larger triangle by great circle paths. Dimples are arranged in each central triangle and each apical triangle so that no dimples intersect the sides of the central triangle. The dimples may be any size, number, or configuration but preferably are selected to optimize aerodynamic performance and minimize or eliminate bald patches.

DESCRIPTION OF THE DRAWINGS

The invention will be explained in conjunction with illustrative embodiments shown in the accompanying drawing, in which

FIGS. 7A through 14A are polar view of golf balls with various dimple patterns in accordance with the invention;

FIGS. 7B through 14B illustrate one of the icosahedral triangles of FIGS. 7A–14A, respectively, and list the dimple diameter or chord for each dimple;

DESCRIPTION OF SPECIFIC EMBODIMENTS

The invention provides new dimple patterns for golf balls which have the following characteristics:

1. Uniform distribution of dimples over the surface of the ball. The spacing between dimples should be even, thereby avoiding heavy concentrations of dimples or rarified areas in which the dimple spacing is large.
2. Multiple axes of symmetry.
3. Absence of multiple, parallel straight rows of dimples, i.e., latitudinal rows.
4. If a dimple pattern is selected which necessarily includes some bald spots, the bald spots will be uniformly distributed over the surface.
5. If multiple dimple sizes are used, the various sized dimples will be distributed and mixed uniformly and symmetrically over the surface of the ball.
6. Provisions are made for a flat parting plane (or planes) to facilitate mold construction.

The surface of a sphere can be divided into twenty spherical equilateral triangles of identical size, corresponding to the faces of a regular icosahedron. Filling each of these triangles with an appropriate number and arrangement of dimples produces a pattern with many axes of symmetry.

Pseudo-icosahedral patterns have been used commercially by various golf ball manufacturers, but these patterns provide only one axis of symmetry because the pattern is interupted at the equator to provide for a mold parting line. This problem can be avoided by subdividing each icosahedral triangle into four smaller spherical triangles by joining the midpoints of the sides of the icosahedral triangle along great circle paths.

Figure 1:
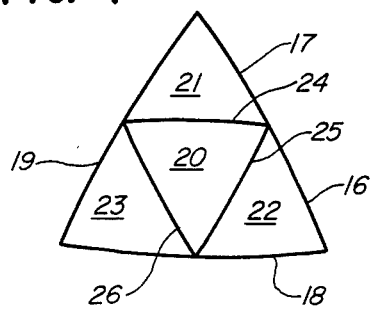
FIG. 1 illustrates one of twenty spherical triangles on the spherical surface of a golf ball which is divided into four smaller triangles by connecting the midpoints of the sides of the larger triangle by great circle paths.

FIG. 1 illustrates a triangle 16 which is one of the twenty identical spherical triangles on the spherical surface of a golf ball which correspond to the faces of a regular icosahedron. The lines 17, 18, and 19 are part of the lines which form the twenty triangles of the icosahedron. The triangle 16 is divided into four smaller triangles—a central triangle 20 and three identical triangles 21, 22, and 23—by three lines 24, 25, and 26 which are part of great circles of the spherical surface of the golf ball. Each of the triangles 21–23 are formed by one of the apexes or vertices of the larger triangle 16 and can be referred to as an apical triangle.

If each of the twenty icosahedral triangles 16 is filled with dimples, none of which cross the boundaries of the central triangle 20, and the ball is covered with twenty such icosahedral triangles, then a pattern with multiple axes of symmetry is created. The boundaries of the central triangles 20 form multiple "false" parting lines which are evenly and regularly distributed over the surface.

Figure 2:
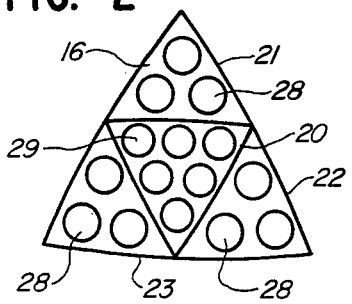
FIGS. 2 through 6 illustrate various dimple patterns for the triangle of FIG. 1.

The dimples used to fill the icosahedral triangles can be any shape and size and can be arranged in any way, depending upon the desired number, density, aesthetic appeal, etc. For example, FIG. 2 illustrates a dimple pattern in which each of the apical triangles 21–23 encloses three identical dimples 28 and the central triangle 20 encloses six identical dimples 29. The dimples 28 are larger than the dimples 29. Since the apical triangles 21–23 are a different size and shape than the central triangle 20, the apical triangles will generally require dimples of different size and/or arrangement than the center triangle 20. Since the golf ball includes twenty icosahedral triangles 16, the golf ball has 180 large dimples 28 and 120 small dimples 29, for a total of 300 dimples.

Figure 3:
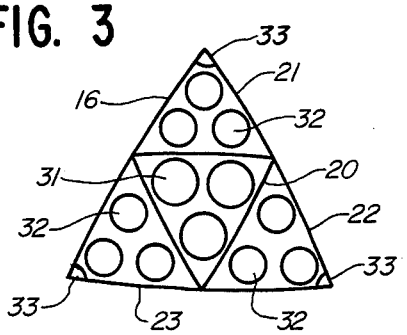

FIG. 3 illustrates a different dimple pattern in which the central triangle 20 encloses three identical large dimples 31 and each of the apical triangles 21–23 encloses three identical whole smaller dimples 32 and a partial dimple 33 which is one-fifth of one of the dimples 32. Each of the apexes of the icosahedral triangle 16 corresponds with an apex of four other icosahedral triangles (see, for example, FIG. 7A), and each of the other four triangles encloses a similar one-fifth dimple 33. The diameter of the dimple which forms the one-fifth dimple 33 is the same as the diameter of the dimples 32. A golf ball having the dimple pattern of FIG. 3 has 60 large dimples 31 and 192 (20×9-3/5) small dimples 32, for a total of 252 dimples.

Figure 4:
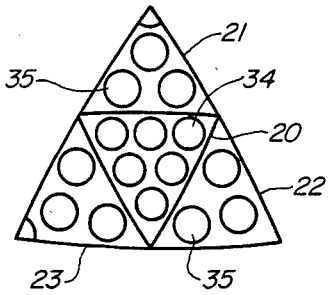

FIG. 4 illustrates a dimple pattern in which the central triangle 20 encloses six small dimples 34 and each of the apical triangles 21–23 encloses three complete larger dimples 35 and one-fifth of a dimple 35. The golf ball has 120 small dimples 34 and 192 (20×9-3/5) large dimples 35, for a total of 312 dimples.

Figure 5:
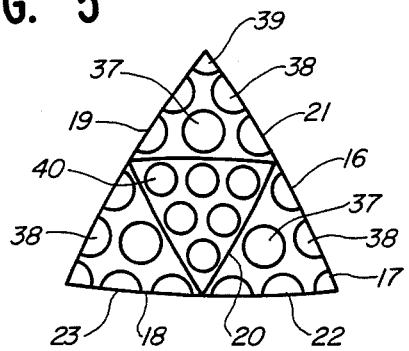

In FIG. 5 each of the apical triangles 21–23 includes one whole dimple 37, four half dixples 38 which are intersected by the sides 17, 18, and 19 of the icosahedral triangle 16, and one one-fifth dimple 39. The other half of each of the half dimples 38 lies in an adjacent icosahedral triangle, and the diameter of each of the half dimples is the same as the diameter of the whole dimples 37. The central triangle 20 encloses six smaller dimples 40. The golf ball has 120 small dimples 40 and 192 (3×3-1/5×20) large dimples 37, or a total of 312 dimples.

Figure 6:
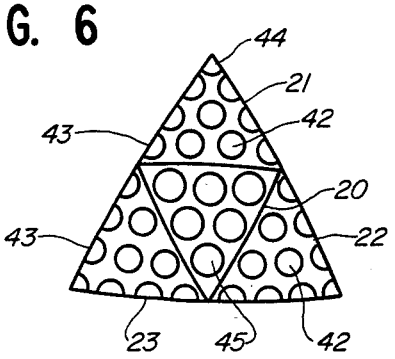

In FIG. 6 each of the apical triangles 21–23 includes three whole dixples 42, six half dixples 43, and one one-fifth dimple 44. The diameters of the dimples 42–44 are the same. The central triangle 20 encloses six larger dimples 45. The golf ball has 120 large dimples 45 and 372 (3×6-1/5×20) small dimples 42, for a total of 492 dimples.

Figure 7A:
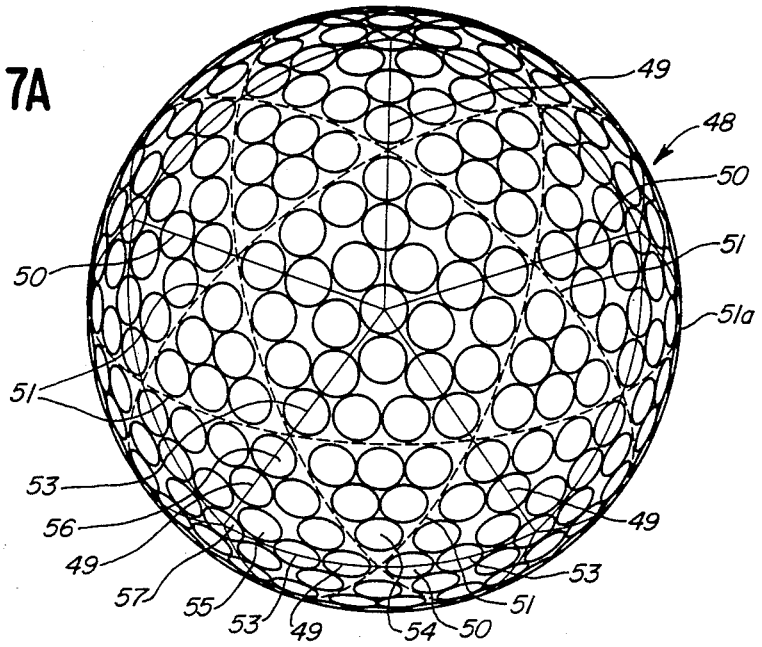

FIG. 7A is a polar view of a golf ball 48 having a dimple pattern in accordance with the invention. The solid lines 49 form the twenty icosahedral spherical triangles 50 which correspond to the faces of a regular icosahedron, and the six dotted lines 51 are great circle paths. In FIG. 7A the great circle path 51*a* is the equator of the ball. Since the icosahedral triangles 50 are identical, any of the apexes where five icosahedral triangles meet can be considered a pole of the ball, and any of the great circle paths 51 can be considered the equator of the ball. The ball therefore has six axes of symmetry which extend perpendicularly to the six equatorial planes and through the six opposed pairs of poles. The mold parting line can be located at any of six equators.

The solid lines 49 and dotted lines 51 are imaginary, of course, and do not appear on the actual golf ball. The lines are shown in the drawing in order to facilitate visualization of the icosahedral triangles, the great circle paths which intersect the sides of the icosahedral triangles, and the way in which the dimples are arranged in the four smaller triangles.

Figure 7B:
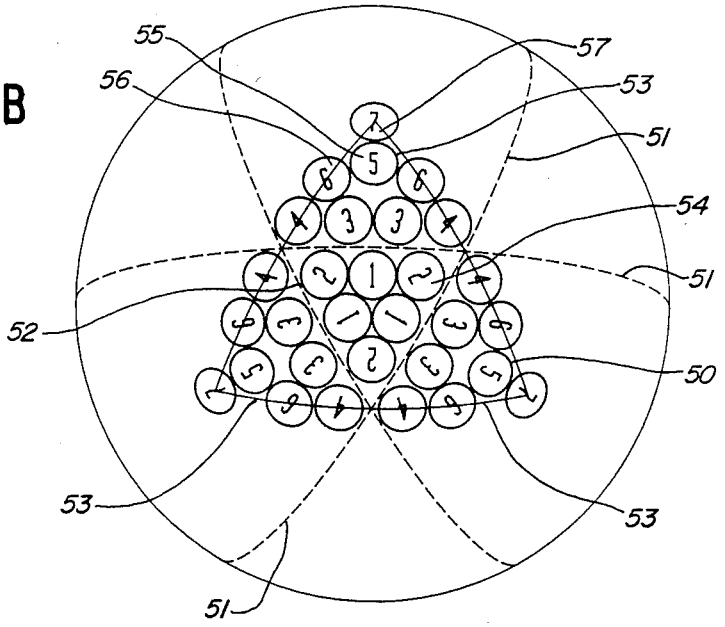

In FIGS. 7A and 7B the three sides of each icosahedral triangle 50 are connected at their midpoints by three great circle paths 51 to form a central triangle 52 and three apical triangles 53. Each central triangle encloses six dimples 54, and each apical triangle encloses three whole dimples 55, four half dimples 56, and one one-fifth dimple 57. The ball has a total of 432 dimples.

FIG. 7B also lists the dimple diameter or chord in inches for each dimple position. Dimple positions 1 and 2 in FIG. 7B have the same chord, 0.135 inch. Dimple positions 3 and 4 also have the same chord 0.140 inch. Dimple position 5 has a chord of 0.150 inch, and dimple positions 6 and 7 have a chord of 0.135 inch.

All dimple dimensions referred to herein refer to the mold or, equivalently, to an unfinished ball as it comes out of the mold rather than to a painted or otherwise finished ball.

Figure 15:
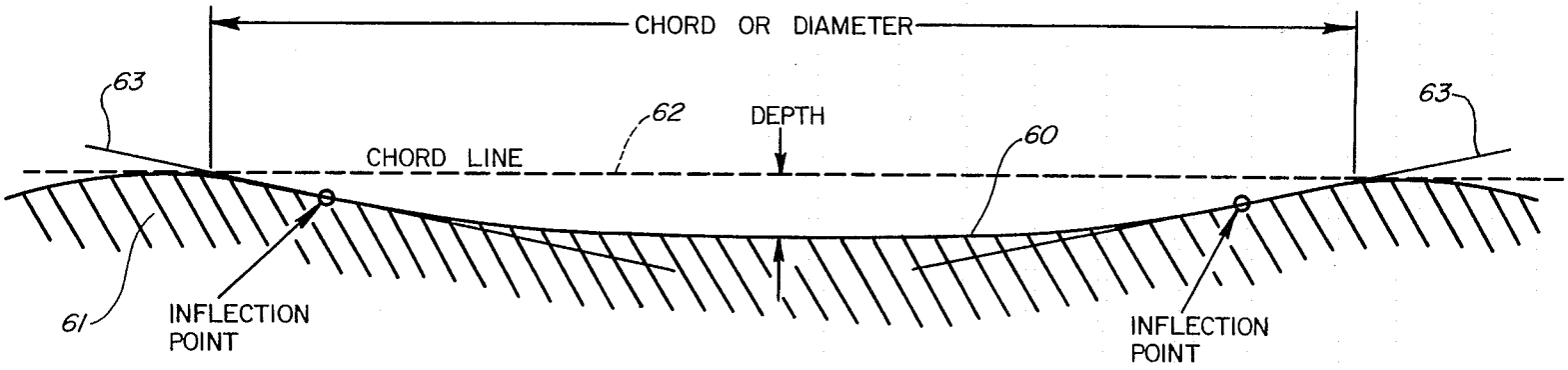
FIG. 15 illustrates the method of determining the dimple diameter or chord and the depth of a dimple.

FIG. 15 shows how the chord and the depth of the dimple 60 of a ball 61 is measured. A chord line 62 is drawn tangent to the ball surface on opposite sides of the dimple. Side wall lines 63 are drawn tangent to the dimple walls at the inflection points of the wall, i.e., where the curvature of the wall changes sign or where the second derivative of the equation for the curve is zero. The intersections of the side wall lines 63 and the chord line 62 define the edges of the dimple and the chord or diameter of the dimple.

The depth of the dimple is measured between the chord line and the bottom of the dimple at its center. I have found that a dimple depth of about 4.7% to about 6.0% of the chord works well, for the dimple pattern shown in FIG. 8A, with the optimum being about 5.2%.

For a dimple in the shape of a truncated cone, the inflection point is actually a line segment of a discrete length.

Figure 8A:
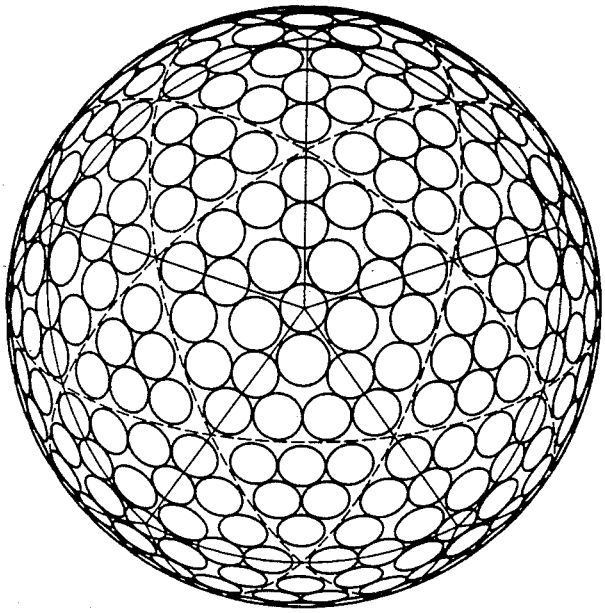
Figure 8B:
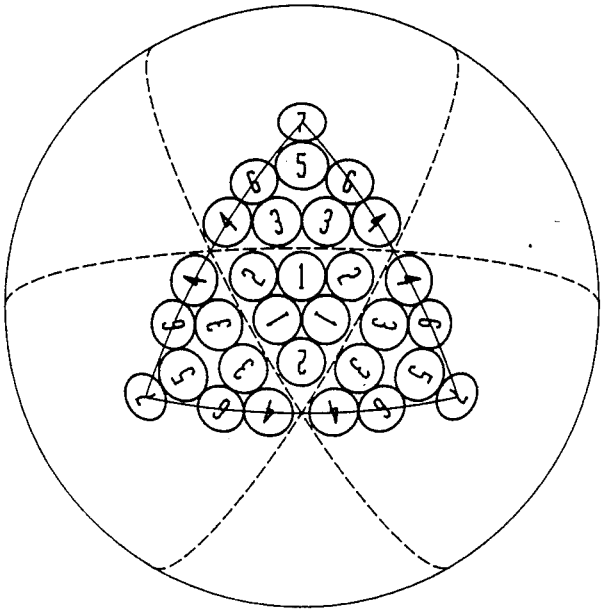

FIGS. 8A and 8B illustrate another dimple pattern with 432 dimples. As can be seen in FIGS. 8B, all of the dimples are the same size and have a chord of 0.135 inch.

Figure 9A:
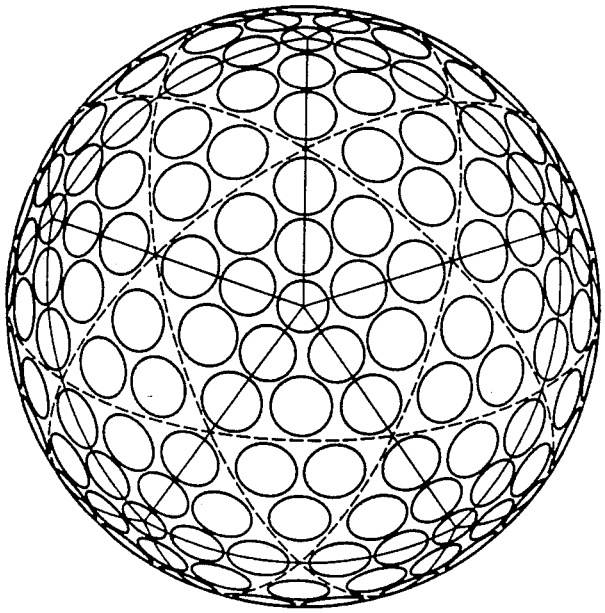
Figure 9B:
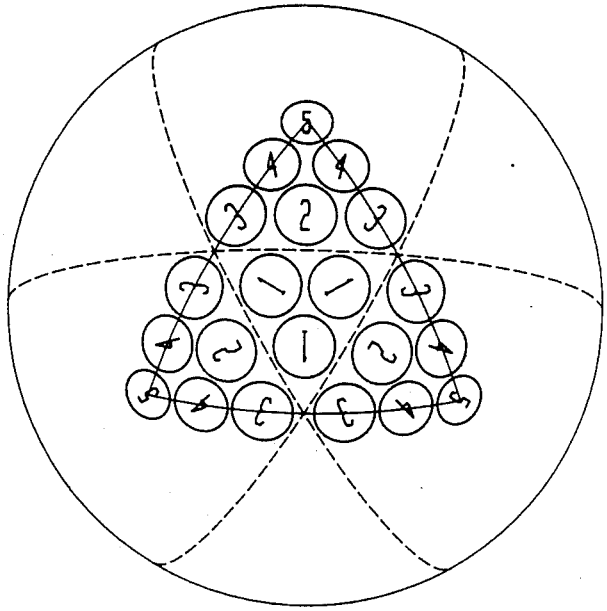

FIGS. 9A and 9B illustrate a dimple pattern with 252 dimples. Referring to FIG. 9B, the dimples in position 1 inside the central triangle have the same diameter. The dimples in positions 2 through 6 have diameters varying from 0.175 inch to 0.145 inch.

Figure 16:
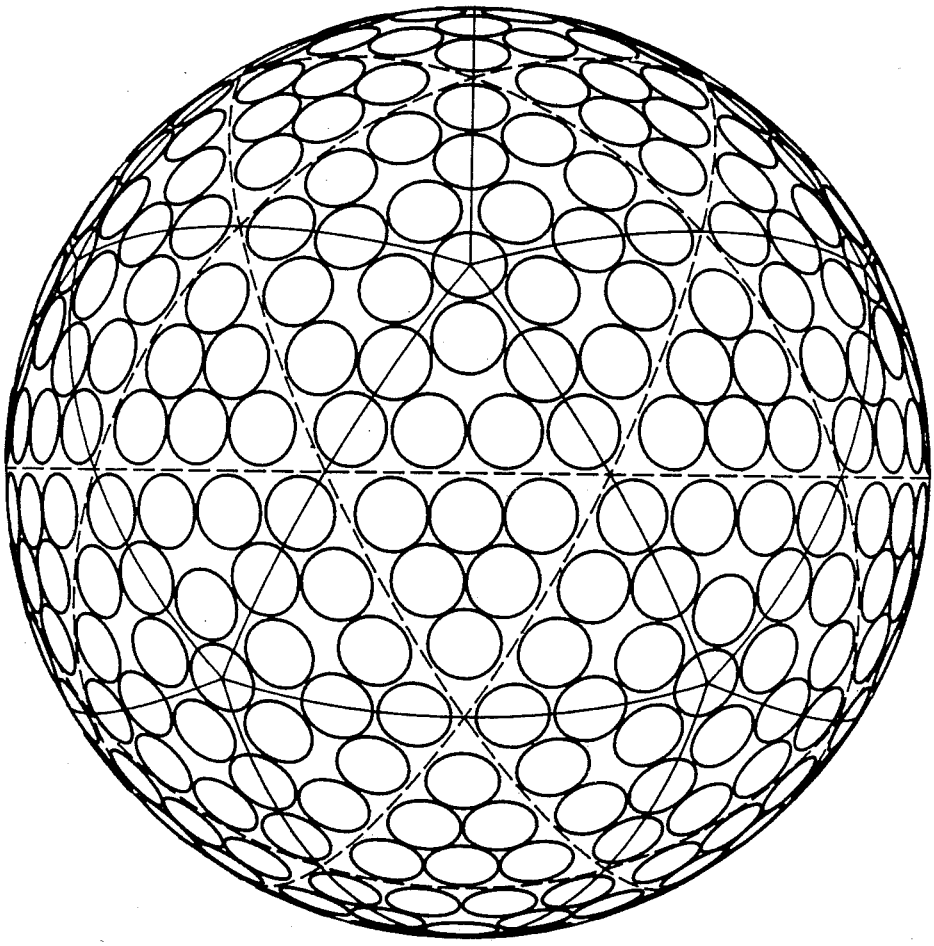
FIG. 16 is an equatorial view of the dimple pattern of FIG. 8A.

FIG. 16 is a view of the dimple pattern of FIGS. 9A and 9B from the equatorial aspect, i.e., the equator or parting line extends across the middle of the ball.

Figure 10A:
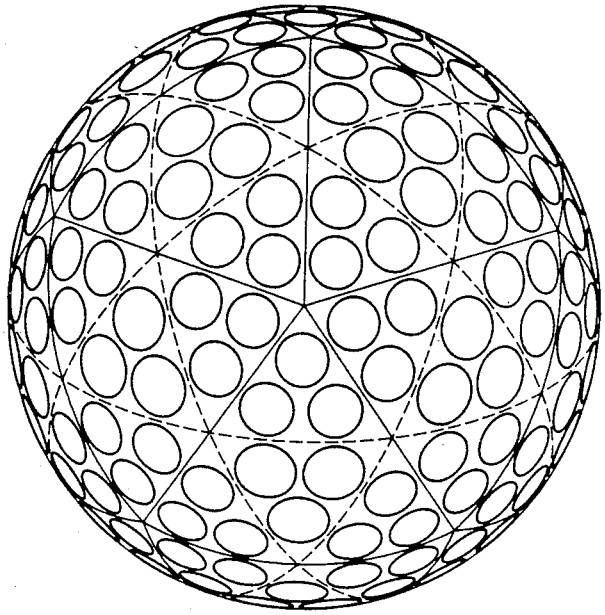
Figure 10B:
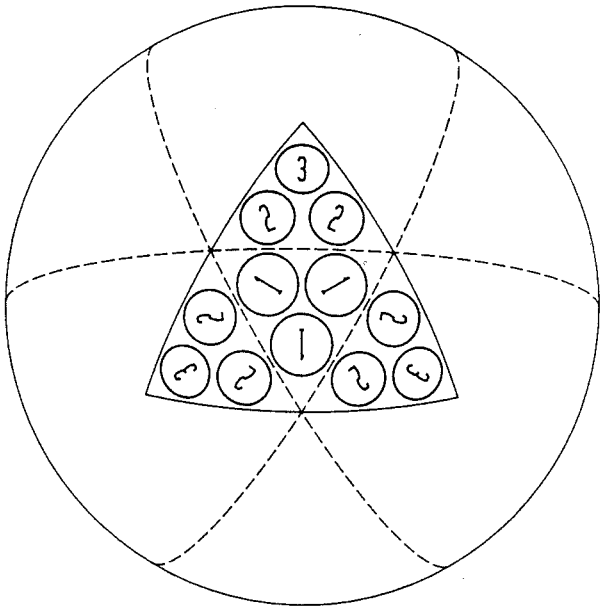

FIGS. 10A and 10B illustrate a dimple pattern having 240 dimples.

Figure 11A:
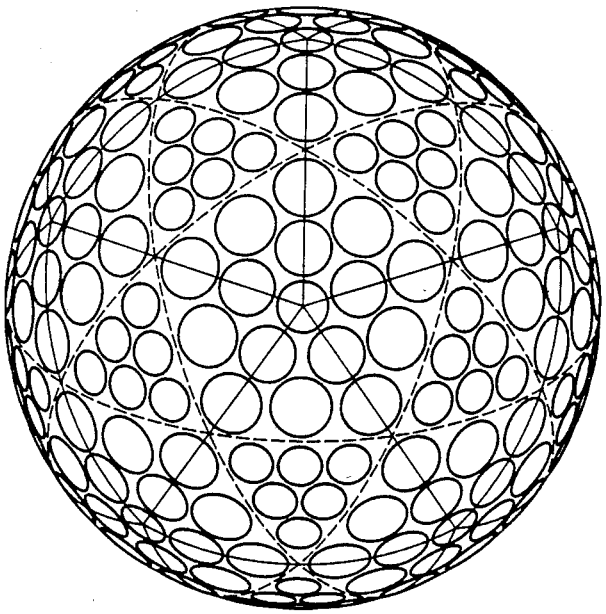
Figure 11B:
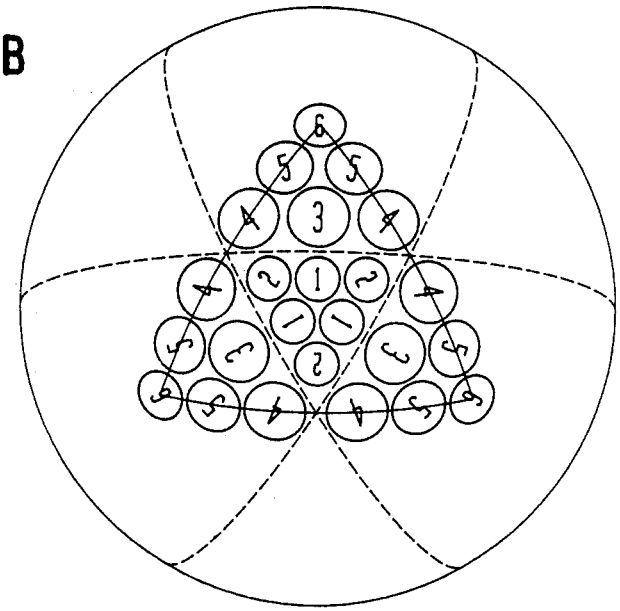

FIGS. 11A and 11B illustrate a dimple pattern having 312 dimples.

Figure 12A:
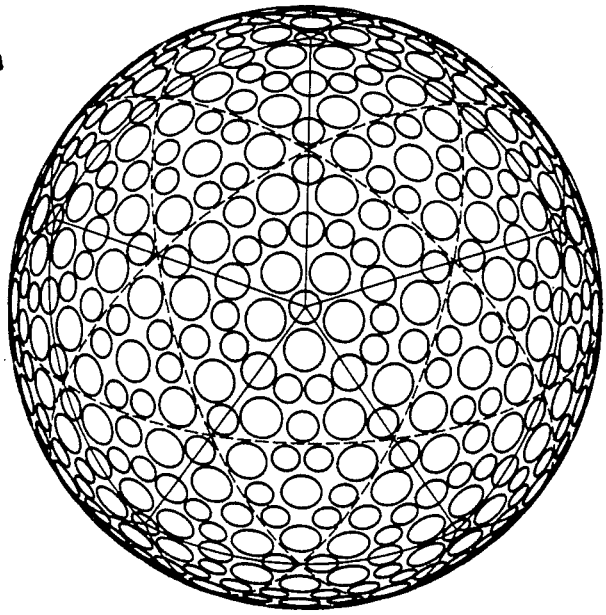
Figure 12B:
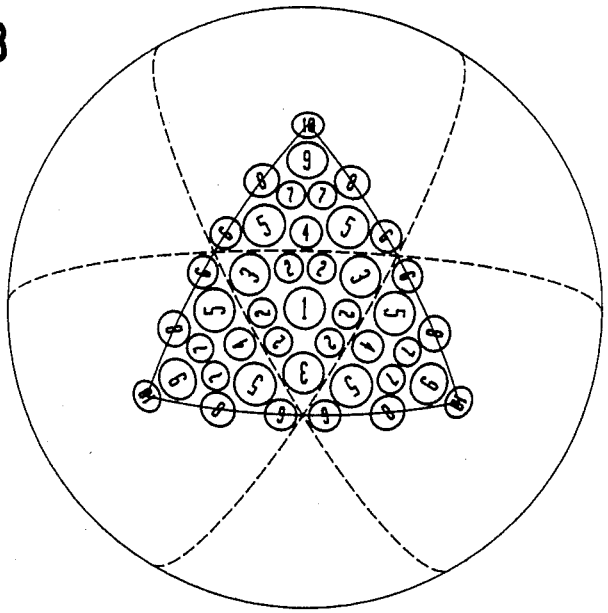

FIGS. 12A and 12B illustrate a dimple pattern having 692 dimples.

Figure 13A:
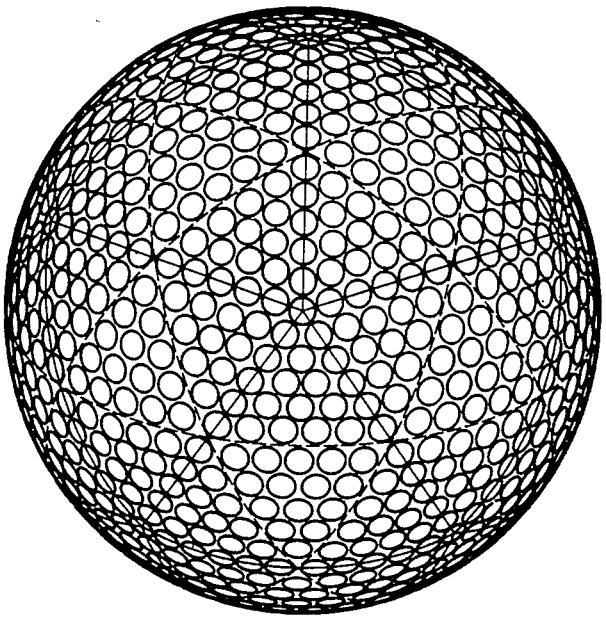
Figure 13B:
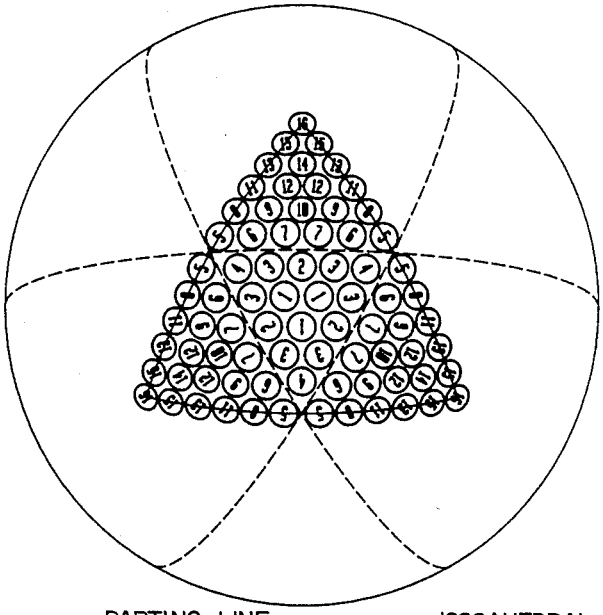

FIGS. 13A and 13B illustrate a dimple pattern having 912 dimples.

Figure 14A:
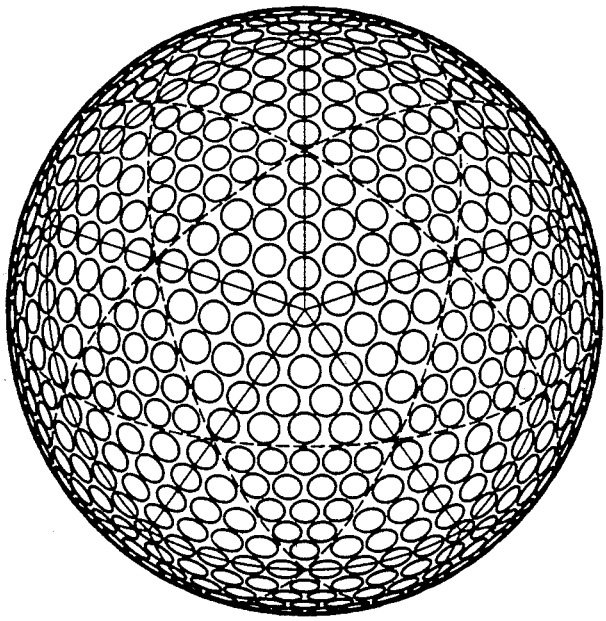
Figure 14B:
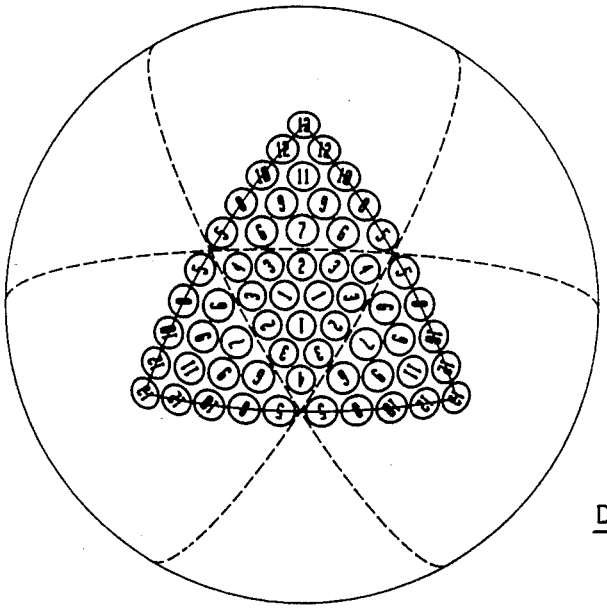

FIGS. 14A and 14B illustrate a dimple pattern having 1212 dimples.

While additional testing is still being performed, it is currently believed that the dimple patterns of FIGS. 7A and 7B and 8A and 8B will provide the best performance, and that the dimple pattern of FIGS. 7A and 7B may be the better pattern.

Balls formed in accordance with the invention have been hit by an automatic hitting machine, and these balls fly longer than conventional balls. It is also believed that balls formed in accordance with the invention will fly more accurately than conventional balls. Further, for balls formed in accordance with the invention, the same dimple depth gives optimum performance for balata three-piece balls, Surlyn three-piece balls, and Surlyn two-piece balls. This is unusual since different dimple depths were heretofore required for these three types of balls.

Because a ball formed in accordance with the invention has six axes of symmetry, the ball will always fly the same way no matter what the orientation of the ball is as it lies on the fairway or the tee. The orientation of the mold parting line will therefore not affect the flight of the ball.

While in the foregoing specification a detailed description of specific embodiments of the invention has been set forth for the purpose of illustration, it will be understood that many of the details herein given may be varied considerably by those skilled in the art without departing from the spirit and scope of the invention.

I claim:

1. A golf ball having a spherical surface with a plurality of dimples formed therein and six great circle paths which do not intersect any dixples, the dimples being arranged by dividing the spherical surface into twenty spherical triangles corresponding to the faces of a regular icosahedron, each of the twenty triangles being subdivided into four smaller triangles consisting of a central triangle and three apical triangles by connecting the midpoints of each of said twenty triangles along great circle paths, said dimples being arranged so that the dimples do not intersect the sides of any of the central triangles.

2. The golf ball of claim 1 in which the dimples in all of said central triangles are of the same size.

3. The golf ball of claim 1 in which the dimples which are not in said central triangles are all of the same size.

4. The golf ball of claim 1 in which all of the dimples are the same size.

5. The golf ball of claim 1 in which the dimples in said central triangles form a first set of dimples and the dimples which are not in said central triangles form a second set of dimples, all of the dimples in the first set being the same size, and all of the dimples in the second set being the same size.

6. The golf ball of claim 4 in which the size of the dimples in the first set is different than the size of the dimples in the second set.

7. The golf ball of claim 1 in which each of said central triangles has the same number of dimples.

8. The golf ball of claim 1 in which said dimples are arranged so that none of the dimples intersect the sides of any of said apical triangles.

9. The golf ball of claim 8 in which each of said apical triangles has the same number of dimples.

10. The golf ball of claim 9 in which the dimples in said apical triangles are all of the same size.

11. The golf ball of claim 9 in which each of said central triangles has the same number of dimples.

12. The golf ball of claim 11 in which the dimples in said central triangles are all of the same size.

13. The golf ball of claim 12 in which the dimples in said apical triangles and the dimples in said central triangles are all of the same size.

14. The golf ball of claim 12 in which the dimples in said apical triangles are of a different size than the dimples in said central triangles.

15. The golf ball of claim 1 in which said dimples are arranged so that some of the dimples lie inside of said apical triangles and some of the dimples are intersected by the sides of said twenty triangles so that each of the apical triangles includes at least one whole dimple and at least one partial dimple.

16. The golf ball of claim 15 in which each of said central triangles has the same number of dimples.

17. The golf ball of claim 15 in which the dimples in the central triangles are the same size as the whole dimples in the apical triangles.

18. The golf ball of claim 15 in which the dimples in the central triangles are of different size than the whole dimples in the apical triangles.

19. The golf ball of claim 15 in which each apical triangle includes a one-fifth dimple which lies at an apex of the apical triangle.

20. The golf ball of claim 15 in which each of the apical triangles includes a plurality of half dimples.

21. The golf ball of claim 15 in which each of the apical triangles includes a plurality of partial dimples, one of the partial dimples in each of the apical triangles being a one-fifth dimple which lies at an apex of the apical triangle, and the other partial dimples in each apical triangle being one-half dimples which lie along two of the sides of the apical triangle.

22. The golf ball of claim 21 in which each of the central triangles has six dimples and each of the apical triangles has three whole dimples, four half dimples, and one one-fifth dimple and the golf ball has a total of 432 dimples.

23. The golf ball of claim 22 in which the dimples in the central triangles are all the same size.

24. The golf ball of claim 21 in which the depth of each dimple is from about 4.7% to about 6.0% of the diameter of the dimple.

25. The golf ball of claim 21 in which the depth of each dimple is about 5.2% of the diameter of the dimple.

26. The golf ball of claim 15 in which the depth of each dimple is from about 4.7% to about 6.0% of the diameter of the dimple.

27. The golf ball of claim 15 in which the depth of each dimple is about 5.2% of the diameter of the dimple.

28. The golf ball of claim 1 in which the depth of each dimple is from about 4.7% to about 6.0% of the diameter of the dimple.

29. The golf ball of claim 1 in which the depth of each dimple is about 5.2% of the diameter of the dimple.

* * * * *

UNITED STATES PATENT AND TRADEMARK OFFICE

CERTIFICATE OF CORRECTION

PATENT NO. : 4,560,168

DATED : December 24, 1985

INVENTOR(S) : Steven Aoyama

It is certified that error appears in the above-identified patent and that said Letters Patent is hereby corrected as shown below:

Col. 5, line 34 change "dixples" to --dimples--.

Signed and Sealed this

*Twentieth* Day of *May 1986*

[SEAL]

*Attest:*

DONALD J. QUIGG

*Attesting Officer*

*Commissioner of Patents and Trademarks*